US011401570B2

(12) United States Patent
Endo et al.

(10) Patent No.: US 11,401,570 B2
(45) **Date of Patent: *Aug. 2, 2022**

(54) MARTENSITIC STAINLESS STEEL SEAMLESS PIPE FOR OIL COUNTRY TUBULAR GOODS, AND METHOD FOR MANUFACTURING SAME

(71) Applicant: JFE Steel Corporation, Tokyo (JP)

(72) Inventors: Mami Endo, Tokyo (JP); Yuichi Kamo, Tokyo (JP); Masao Yuga, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 30 days.

This patent is subject to a terminal disclaimer.

(21) Appl. No.: 16/646,354

(22) PCT Filed: Sep. 4, 2018

(86) PCT No.: PCT/JP2018/032692

§ 371 (c)(1),
(2) Date: Mar. 11, 2020

(87) PCT Pub. No.: WO2019/065116

PCT Pub. Date: Apr. 4, 2019

(65) Prior Publication Data

US 2020/0270715 A1 Aug. 27, 2020

(30) Foreign Application Priority Data

Sep. 29, 2017 (JP) ..... JP2017-190074

(51) Int. Cl.

| | |
|---|---|
| ***C22C 38/04*** | (2006.01) |
| ***C21D 9/08*** | (2006.01) |
| ***C21D 6/00*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C21D 9/085* (2013.01); *C21D 6/004* (2013.01); *C21D 6/005* (2013.01); *C21D 6/008* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/008* (2013.01)

(58) Field of Classification Search

CPC ..... C21D 6/004

See application file for complete search history.

(56) References Cited

U.S. PATENT DOCUMENTS

| | | | | |
|---|---|---|---|---|
| 5,778,714 | A | 7/1998 | Katsumura et al. | |
| 11,085,095 | B2 | 8/2021 | Eguchi et al. | |
| 2005/0224143 | A1 | 10/2005 | Takabe et al. | |
| 2009/0017238 | A1 | 1/2009 | Miyata et al. | |
| 2009/0162239 | A1 | 6/2009 | Takabe et al. | |
| 2015/0152531 | A1 | 6/2015 | Eguchi et al. | |
| 2015/0315684 | A1 | 11/2015 | Eguchi et al. | |
| 2017/0029912 | A1 | 2/2017 | De Carvalho et al. | |
| 2018/0237879 | A1 | 8/2018 | Motoya et al. | |
| 2019/0177823 | A1 | 6/2019 | Matsuo et al. | |
| 2019/0241989 | A1* | 8/2019 | Endo | C22C 38/48 |
| 2019/0376157 | A1* | 12/2019 | Kamo | C22C 38/54 |
| 2020/0157646 | A1 | 5/2020 | Eguchi et al. | |

(Continued)

FOREIGN PATENT DOCUMENTS

| | | | |
|---|---|---|---|
| EP | 2060644 | A1 | 5/2009 |
| EP | 2565287 | A1 | 3/2013 |

(Continued)

OTHER PUBLICATIONS

International Search Report and Written Opinion for International Application No. PCT/JP2018/032692, dated Nov. 27, 2018, 6 pages.

(Continued)

*Primary Examiner* — Jophy S. Koshy
(74) *Attorney, Agent, or Firm* — RatnerPrestia

(57) ABSTRACT

The invention is intended to provide a martensitic stainless steel seamless pipe for oil country tubular goods having high strength, and excellent sulfide stress corrosion cracking resistance. A method for manufacturing such a martensitic stainless steel seamless pipe is also provided. The martensitic stainless steel seamless pipe for oil country tubular goods has a yield stress of 758 MPa or more, and a composition that contains, in mass %, C: 0.0010 to 0.0094%, Si: 0.5% or less, Mn: 0.05 to 0.5%, P: 0.030% or less, S: 0.005% or less, Ni: 4.6 to 7.3%, Cr: 10.0 to 14.5%, Mo: 1.0 to 2.7%, Al: 0.1% or less, V: 0.2% or less, N: 0.1% or less, Ti: 0.01 to 0.50%, Cu: 0.01 to 1.0%, and Co: 0.01 to 1.0%, in which C, Mn, Cr, Cu, Ni, Mo, W, Nb, N, and Ti satisfy the predetermined relations, and the balance is Fe and incidental impurities.

8 Claims, No Drawings

(56) References Cited

U.S. PATENT DOCUMENTS

| | | | | |
|---|---|---|---|---|
| 2020/0216936 | A1* | 7/2020 | Kamo | C22C 38/04 |
| 2020/0283866 | A1* | 9/2020 | Endo | C21D 8/105 |

FOREIGN PATENT DOCUMENTS

| | | | | |
|---|---|---|---|---|
| EP | 2918697 | A1 | 9/2015 | |
| EP | 3112492 | A1 | 1/2017 | |
| EP | 3604591 | A1 | 2/2020 | |
| JP | 2000160300 | A | 6/2000 | |
| JP | 2003003243 | A | 1/2003 | |
| JP | 2007332442 | A | 12/2007 | |
| JP | 2010242163 | A | 10/2010 | |
| JP | 2015161010 | A | 9/2015 | |
| JP | 2017510715 | A | 4/2017 | |
| WO | 2004057050 | A1 | 7/2004 | |
| WO | 2008023702 | A1 | 2/2008 | |
| WO | 2017038178 | A1 | 3/2017 | |
| WO | 2017200083 | A1 | 11/2017 | |
| WO | WO-2017200083 | A1 * | 11/2017 | C22C 38/46 |
| WO | 2018079111 | A1 | 5/2018 | |
| WO | 2018181404 | A1 | 10/2018 | |

OTHER PUBLICATIONS

Extended European Search Report for European Application No. 18860839.2, dated Jun. 5, 2020, 12 pages.

Japanese Office Action for Japanese Application No. 2018-564433, dated Feb. 5, 2019, with Concise Statement of Relevance of Office Action, 5 pages.

Boljanovic, "Metal Shaping Processes: Casting and Molding; Particulate Processing; Deformation Processes; and Metal Removal" downloaded at https://app.knovel.com/web/view/khtml/print.v/rcid:kpMSPCMPP1/cid:kt009XJ121/viewerType:khtml/?notes=off, 2010, 22 pages.

* cited by examiner

MARTENSITIC STAINLESS STEEL SEAMLESS PIPE FOR OIL COUNTRY TUBULAR GOODS, AND METHOD FOR MANUFACTURING SAME

CROSS REFERENCE TO RELATED APPLICATIONS

This is the U.S. National Phase application of PCT/JP2018/032692, filed Sep. 4, 2018, which claims priority to Japanese Patent Application No. 2017-190074, filed Sep. 29, 2017, the disclosures of each of these applications being incorporated herein by reference in their entireties for all purposes.

FIELD OF THE INVENTION

The present invention relates to a martensitic stainless steel seamless pipe for oil country tubular goods for use in crude oil well and natural gas well applications (hereinafter, referred to simply as "oil country tubular goods"), and to a method for manufacturing such a martensitic stainless steel seamless pipe. Particularly, the invention relates to improvement of sulfide stress corrosion cracking resistance (SSC resistance) in a hydrogen sulfide ($H_2S$)-containing environment.

BACKGROUND OF THE INVENTION

Increasing crude oil prices and an expected shortage of petroleum resources in the near future have prompted active development of oil country tubular goods for use in applications that were unthinkable in the past, for example, such as in deep oil fields, and in oil fields and gas oil fields of severe corrosive environments containing carbon dioxide gas, chlorine ions, and hydrogen sulfide. The material of steel pipes for oil country tubular goods intended for these environments require high strength, and excellent corrosion resistance.

Oil country tubular goods used for mining of oil fields and gas fields of an environment containing carbon dioxide gas, chlorine ions, and the like typically use 13% Cr martensitic stainless steel pipes. There has also been global development of oil fields or the like in very severe corrosive environments containing hydrogen sulfide. Accordingly, the need for SSC resistance is high, and there has been increasing use of an improved 13% Cr martensitic stainless steel pipe of a reduced C content and increased Ni and Mo contents.

PTL 1 describes a composition using a 13% Cr-base steel as a basic composition, in which C is contained in a much smaller content than in common stainless steels, and Ni, Mo, and Cu are contained so as to satisfy $Cr+2Ni+1.1Mo+0.7Cu \leq 32.5$. The composition also contains at least one of Nb: 0.20% or less, and V: 0.20% or less so as to satisfy the condition $Nb+V \geq 0.05\%$. It is stated in PTL 1 that this will provide high strength with a yield stress of 965 MPa or more, high toughness with a Charpy absorption energy at −40° C. of 50 J or more, and desirable corrosion resistance.

PTL 2 describes a 13% Cr-base martensitic stainless steel pipe of a composition containing carbon in an ultra low content of 0.015% or less, and 0.03% or more of Ti. It is stated in PTL 2 that this stainless steel pipe has high strength with a yield stress on the order of 95 ksi, low hardness with an HRC of less than 27, and excellent SSC resistance. PTL 3 describes a martensitic stainless steel that satisfies $6.0 \leq Ti/C \leq 10.1$, based on the finding that Ti/C has a correlation with a value obtained by subtracting a yield stress from a tensile stress. It is stated in PTL 3 that this technique, with a value of 20.7 MPa or more yielded as the difference between tensile stress and yield stress, can reduce hardness variation that impairs SSC resistance.

PTL 4 describes a martensitic stainless steel containing Mo in a limited content of $Mo \geq 2.3-0.89Si+32.2C$, and having a metal microstructure composed mainly of tempered martensite, carbides that have precipitated during tempering, and intermetallic compounds such as a Laves phase and a δ phase formed as fine precipitates during tempering. It is stated in PTL 4 that the steel produced by this technique has high strength with a 0.2% proof stress of 860 MPa or more, and excellent carbon dioxide corrosion resistance and sulfide stress corrosion cracking resistance.

PATENT LITERATURE

PTL 1: JP-A-2007-332442
PTL 2: JP-A-2010-242163
PTL 3: WO2008/023702
PTL 4: WO2004/057050

SUMMARY OF THE INVENTION

The development of recent oil fields and gas fields is made in severe corrosive environments containing $CO_2$, $Cl^-$, and $H_2S$. Increasing $H_2S$ concentrations due to aging of oil fields and gas fields are also of concern. Steel pipes for oil country tubular goods for use in these environments are therefore required to have excellent sulfide stress corrosion cracking resistance (SSC resistance). However, the technique described in PTL 1, which describes a steel having excellent corrosion resistance against $CO_2$, does not take into account sulfide stress corrosion cracking resistance, and it cannot be said that the steel has corrosion resistance against a severe corrosive environment.

PTL 2 states that sulfide stress cracking resistance can be maintained under an applied stress of 655 MPa in an atmosphere of a 5% NaCl aqueous solution ($H_2S$: 0.10 bar) having an adjusted pH of 3.5. The steel described in PTL 3 has sulfide stress cracking resistance in an atmosphere of a 20% NaCl aqueous solution ($H_2S$: 0.03 bar, $CO_2$ bal.) having an adjusted pH of 4.5. The steel described in PTL 4 has sulfide stress cracking resistance in an atmosphere of a 25% NaCl aqueous solution ($H_2S$: 0.03 bar, $CO_2$ bal.) having an adjusted pH of 4.0. However, these patent applications do not take into account sulfide stress corrosion cracking resistance in other atmospheres, and it cannot be said that the steels described in these patent applications have the level of sulfide stress corrosion cracking resistance that can withstand the today's ever demanding severe corrosive environments.

It is accordingly an object of the present invention to provide a martensitic stainless steel seamless pipe for oil country tubular goods having high strength and excellent sulfide stress corrosion cracking resistance. The invention is also intended to provide a method for manufacturing such a martensitic stainless steel seamless pipe.

As used herein, "high strength" means a yield stress of 758 MPa (110 ksi) or more. The yield stress is preferably 896 MPa or less.

As used herein, "excellent sulfide stress corrosion cracking resistance" means that a test piece dipped in a test solution (a 0.165 mass % NaCl aqueous solution; liquid temperature: 25° C.; $H_2S$: 1 bar; $CO_2$ bal.) having an adjusted pH of 3.5 with addition of sodium acetate and hydrochloric acid does not crack even after 720 hours under an applied stress equal to 90% of the yield stress.

In order to achieve the foregoing objects, the present inventors conducted intensive studies of the effects of various alloy elements on sulfide stress corrosion cracking resistance (SSC resistance) in a $CO_2$, $Cl^-$-, and $H_2S$-containing corrosive environment, using a 13% Cr-base stainless steel pipe as a basic composition. The studies found that a martensitic stainless steel seamless pipe for oil country tubular goods having the desired strength, and excellent SSC resistance in a $CO_2$, $Cl^-$-, and $H_2S$-containing corrosive environment, and in an environment under an applied stress close to the yield stress can be provided when the steel components are contained in predetermined ranges, and C, Mn, Cr, Cu, Ni, Mo, W, Nb, N, and Ti are contained in adjusted amounts that satisfy appropriate relations and ranges, and when the steel is subjected to appropriate quenching and tempering.

The present invention is based on this finding, and was completed after further studies. Specifically, the gist of the exemplary embodiments of the present invention is as follows.

[1] A martensitic stainless steel seamless pipe for oil country tubular goods having a yield stress of 758 MPa or more, the martensitic stainless steel seamless pipe comprising, in mass %, C: 0.0010 to 0.0094%, Si: 0.5% or less, Mn: 0.05 to 0.5%, P: 0.030% or less, S: 0.005% or less, Ni: 4.6 to 7.3%, Cr: 10.0 to 14.5%, Mo: 1.0 to 2.7%, Al: 0.1% or less, V: 0.2% or less, N: 0.1% or less, Ti: 0.01 to 0.50%, Cu: 0.01 to 1.0%, and Co: 0.01 to 1.0%, in which the values of the following formulae (1) and (2) satisfy the formulae (3) below, and the balance is Fe and incidental impurities.

$$-109.37C+7.307Mn+6.399Cr+6.329Cu+11.343Ni-13.529Mo+1.276W+2.925Nb+196.775N-2.621Ti-120.307 \quad \text{Formula (1)}$$

$$-1.324C+0.0533Mn+0.0268Cr+0.0893Cu+0.00526Ni+0.0222Mo-0.0132W-0.473N-0.5Ti-0.514 \quad \text{Formula (2)}$$

In the formulae, C, Mn, Cr, Cu, Ni, Mo, W, Nb, N, and Ti represent the content of each element in mass %, and the content is 0 (zero) for elements that are not contained.

$$-35.0 \leq \text{value of formula (1)} \leq 45, \text{ and}$$

$$-0.40 \leq \text{value of formula (2)} \leq 0.070 \quad \text{Formulae (3)}$$

[2] The martensitic stainless steel seamless pipe for oil country tubular goods according to item [1], wherein the composition further comprises, in mass %, at least one selected from Nb: 0.25% or less, and W: 1.1% or less.

[3] The martensitic stainless steel seamless pipe for oil country tubular goods according to item [1] or [2], wherein the composition further comprises, in mass %, one or more selected from Ca: 0.010% or less, REM: 0.010% or less, Mg: 0.010% or less, and B: 0.010% or less.

[4] A method for manufacturing a martensitic stainless steel seamless pipe for oil country tubular goods, the method comprising:

forming a steel pipe from a steel pipe material of the composition of any one of items [1] to [3];

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

The exemplary embodiments of the present invention has enabled production of a martensitic stainless steel seamless pipe for oil country tubular goods having excellent sulfide stress corrosion cracking resistance (SSC resistance) in a $CO_2$, $Cl^-$-, and $H_2S$-containing corrosive environment, and high strength with a yield stress YS of 758 MPa (110 ksi) or more.

DETAILED DESCRIPTION OF EMBODIMENTS OF THE INVENTION

The following describes the reasons for specifying the composition of a steel pipe of the present invention. In the following, "%" means percent by mass, unless otherwise specifically stated.

C: 0.0010 to 0.0094%

C is an important element involved in the strength of the martensitic stainless steel, and is effective at improving strength. C needs to be contained in an amount of 0.0010% or more to obtain the strength desired in the present invention. When contained in an amount of more than 0.0094%, C generates chromium carbonitrides, and impairs the corrosion resistance. For this reason, the C content is limited to 0.0010 to 0.0094% in an embodiment of the present invention. The C content is preferably 0.0050 to 0.0094%.

Si: 0.5% or Less

Si acts as a deoxidizing agent, and is contained in an amount of desirably 0.05% or more. A Si content of more than 0.5% impairs carbon dioxide corrosion resistance and hot workability. For this reason, the Si content is limited to 0.5% or less. Preferably, the Si content is 0.10 to 0.30%.

Mn: 0.05 to 0.5%

Mn is an element that improves hot workability, and is contained in an amount of 0.05% or more to provide the necessary strength. When Mn is contained in an amount of more than 0.5%, the effect becomes saturated, and the cost increases. For this reason, the Mn content is limited to 0.05 to 0.5%. Preferably, the Mn content is 0.4% or less.

P: 0.030% or Less

P is an element that impairs carbon dioxide corrosion resistance, pitting corrosion resistance, and sulfide stress corrosion cracking resistance, and should desirably be contained in as small an amount as possible in the present invention. However, an excessively small P content increases the manufacturing cost. For this reason, the P content is limited to 0.030% or less, which is a content range that does not cause a severe impairment of characteristics, and that is economically practical in industrial applications. Preferably, the P content is 0.020% or less.

S: 0.005% or Less

S is an element that seriously impairs hot workability, and should desirably be contained in as small an amount as possible. A reduced S content of 0.005% or less enables pipe production using an ordinary process, and the S content is limited to 0.005% or less in an embodiment of the present invention. Preferably, the S content is 0.003% or less.

Ni: 4.6 to 7.3%

Ni is an element that increases the strength of the protective coating, and improves the corrosion resistance. Ni also increases steel strength by forming a solid solution. Ni needs to be contained in an amount of 4.6% or more to obtain these effects. With a Ni content of more than 7.3%, the martensite phase becomes less stable, and the strength decreases. For this reason, the Ni content is limited to 4.6 to 7.3%.

Cr: 10.0 to 14.5%

Cr is an element that forms a protective coating, and improves the corrosion resistance. The required corrosion resistance for oil country tubular goods can be provided when Cr is contained in an amount of 10.0% or more. A Cr content of more than 14.5% facilitates ferrite generation, and a stable martensite phase cannot be provided. For this reason, the Cr content is limited to 10.0 to 14.5%. Preferably, the Cr content is 11.0 to 13.5%.

Mo: 1.0 to 2.7%

Mo is an element that improves the resistance against pitting corrosion by $Cl^-$. Mo needs to be contained in an amount of 1.0% or more to obtain the corrosion resistance necessary for a severe corrosive environment. When Mo is contained in an amount of more than 2.7%, the effect becomes saturated. Such a high Mo content also increases hardness, and impairs the corrosion resistance. Mo is also an expensive element, and increases the manufacturing cost. For this reason, the Mo content is limited to 1.0 to 2.7%. Preferably, the Mo content is 1.5 to 2.5%.

Al: 0.1% or Less

Al acts as a deoxidizing agent, and an Al content of 0.01% or more is effective for obtaining this effect. However, Al has an adverse effect on toughness when contained in an amount of more than 0.1%. For this reason, the Al content is limited to 0.1% or less in an embodiment of the present invention. Preferably, the Al content is 0.01 to 0.03%.

V: 0.2% or Less

V is contained in an amount of desirably 0.005% or more to improve steel strength through precipitation hardening, and to improve sulfide stress corrosion cracking resistance. Because a V content of more than 0.2% impairs toughness, the V content is limited to 0.2% or less in an embodiment of the present invention. The V content is preferably 0.01 to 0.08%.

N: 0.1% or Less

N is an element that greatly improves pitting corrosion resistance. However, N forms various nitrides, and impairs toughness when contained in an amount of more than 0.1%. For this reason, the N content is limited to 0.1% or less in an embodiment of the present invention. Preferably, the N content is 0.004 to 0.08%, more preferably 0.005 to 0.05%.

Ti: 0.01 to 0.50%

Ti forms titanium carbides by binding to C, and makes the C content considerably small. A Ti content of 0.01% or more is needed to obtain this effect. When contained in an amount of more than 0.50%, Ti generates coarse carbides, which impair toughness and sulfide stress corrosion cracking resistance. For this reason, the Ti content is limited to 0.01 to 0.50%. The Ti content is preferably 0.05 to 0.15%.

Cu: 0.01 to 1.0%

When contained in an amount of 0.01% or more, Cu adds strength to the protective coating, reduces active dissolution, and improves sulfide stress corrosion cracking resistance. When contained in an amount of more than 1.0%, Cu precipitates into CuS, and impairs hot workability. For this reason, the Cu content is limited to 0.01 to 1.0%.

Co: 0.01 to 1.0%

Co is an element that reduces hardness, and improves pitting corrosion resistance by raising the Ms point, and promoting α transformation. Co needs to be contained in an amount of 0.01% or more to obtain these effects. When contained in excessively large amounts, Co may impair toughness, and increases the material cost. For this reason, the Co content is limited to 0.01 to 1.0% in an embodiment of the present invention.

In an embodiment of the present invention, C, Mn, Cr, Cu, Ni, Mo, W, Nb, N, and Ti are contained so that the values of the following formulae (1) and (2) satisfy the formulae (3) below. Formula (1) correlates these elements with an amount of retained γ. By making the value of formula (1) smaller, the retained austenite occurs in smaller amounts, the hardness decreases, and the sulfide stress corrosion cracking resistance improves. Formula (2) correlates the elements with pitting corrosion potential. When C, Mn, Cr, Cu, Ni, Mo, W, N, and Ti are contained so that the value of formula (2) satisfies the range of formula (3), generation of pitting corrosion, which becomes an initiation point of sulfide stress corrosion cracking, can be reduced, and the sulfide stress corrosion cracking resistance greatly improves. The hardness increases when the value of formula (1) is 10 or more. However, it is still possible to effectively reduce generation of pitting corrosion and improve sulfide stress corrosion cracking resistance when the value of formula (2) satisfies the range of formula (3).

$$-109.37C+7.307Mn+6.399Cr+6.329Cu+11.343Ni-13.529Mo+1.276W+2.925Nb+196.775N-2.621Ti-120.307 \quad \text{Formula (1)}$$

$$-1.324C+0.0533Mn+0.0268Cr+0.0893Cu+0.00526Ni+0.0222Mo-0.0132W-0.473N-0.5Ti-0.514 \quad \text{Formula (2)}$$

In the formulae, C, Mn, Cr, Cu, Ni, Mo, W, Nb, N, and Ti represent the content of each element in mass %, and the content is 0 (zero) for elements that are not contained.

$$-35.0 \leq \text{value of formula (1)} \leq 45, \text{ and}$$

$$-0.40 \leq \text{value of formula (2)} \leq 0.070 \quad \text{Formulae (3)}$$

At least one selected from Nb: 0.25% or less, and W: 1.1% or less may be contained as optional elements, as needed.

Nb forms carbides, and can reduce hardness by reducing solid-solution carbon. However, Nb may impair toughness when contained in an excessively large amount. W is an element that improves pitting corrosion resistance. However, W may impair toughness, and increases the material cost when contained in an excessively large amount. For this reason, Nb and W, when contained, are contained in limited amounts of Nb: 0.25% or less, and W: 1.1% or less.

One or more selected from Ca: 0.010% or less, REM: 0.010% or less, Mg: 0.010% or less, and B: 0.010% or less may be contained as optional elements, as needed.

Ca, REM, Mg, and B are elements that improve corrosion resistance by controlling the form of inclusions. The desired contents for providing this effect are Ca: 0.0005% or more, REM: 0.0005% or more, Mg: 0.0005% or more, and B: 0.0005% or more. Ca, REM, Mg, and B impair toughness and carbon dioxide corrosion resistance when contained in amounts of more than Ca: 0.010%, REM: 0.010%, Mg: 0.010%, and B: 0.010%. For this reason, the contents of Ca, REM, Mg, and B, when contained, are limited to Ca: 0.010% or less, REM: 0.010% or less, Mg: 0.010% or less, and B: 0.010% or less.

The balance is Fe and incidental impurities in the composition.

The following describes a preferred method for manufacturing a stainless steel seamless pipe for oil country tubular goods of the present invention.

In the present invention, a steel pipe material of the foregoing composition is used. However, the method of production of a stainless steel seamless pipe used as a steel pipe material is not particularly limited, and any known seamless pipe producing method may be used.

Preferably, a molten steel of the foregoing composition is made into steel using an ordinary steel making process such as by using a converter, and formed into a steel pipe material, for example, a billet, using a method such as continuous casting, or ingot casting-blooming. The steel pipe material is then heated, and hot worked into a pipe using a known pipe manufacturing process, for example, the Mannesmann-plug mill process, or the Mannesmann-mandrel mill process to produce a seamless steel pipe of the foregoing composition.

The process after the production of the steel pipe from the steel pipe material is not particularly limited. Preferably, the steel pipe is subjected to quenching in which the steel pipe is heated to a temperature equal to or greater than an $Ac_3$ transformation point, and cooled to a cooling stop temperature of 100° C. or less, followed by tempering at a temperature equal to or less than an $Ac_1$ transformation point.

Quenching

In the present invention, the steel pipe is reheated to a temperature equal to or greater than an $Ac_3$ transformation point, held for preferably at least 5 min, and cooled to a cooling stop temperature of 100° C. or less. This makes it possible to produce a refined, tough martensite phase. When the quenching heating temperature is less than an $Ac_3$ transformation point, the microstructure does not occur in the austenite single-phase region, and a sufficient martensite microstructure does not occur in the subsequent cooling, with the result that the desired high strength cannot be obtained. For this reason, the quenching heating temperature is limited to a temperature equal to or greater than an $Ac_3$ transformation point. The cooling method is not limited. Typically, the steel pipe is air cooled (at a cooling rate of 0.05° C./s or more and 20° C./s or less) or water cooled (at a cooling rate of 5° C./s or more and 100° C./s or less), and the cooling rate conditions are not limited either.

Tempering

The quenched steel pipe is tempered. The tempering is a process in which the steel pipe is heated to a temperature equal to or less than an $Ac_1$ transformation point, held for preferably at least 10 min, and cooled. When the tempering temperature is higher than an $Ac_1$ transformation point, the martensite phase precipitates after the tempering, and the desired high toughness and excellent corrosion resistance cannot be provided. For this reason, the tempering temperature is limited to a temperature equal to or less than an $Ac_1$ transformation point. The $Ac_3$ transformation point (° C.) and the $Ac_1$ transformation point (° C.) can be determined by giving a heating and cooling temperature history to a test piece, and finding a transformation point from a microdisplacement due to expansion and contraction in a Formaster test.

Examples

The present invention is further described below through Examples.

Molten steels containing the components shown in Table 1 were made into steel with a converter, and cast into billets (steel pipe material) by continuous casting. The billet was hot worked into a pipe with a model seamless rolling mill, and cooled by air cooling or water cooling to produce a seamless steel pipe measuring 83.8 mm in outer diameter and 12.7 mm in wall thickness.

Each seamless steel pipe was cut to obtain a test material, which was then subjected to quenching and tempering under the conditions shown in Table 2. A test piece for microstructure observation was taken from the quenched and tempered test material. After polishing, the amount of retained austenite (γ) was measured by X-ray diffractometry.

Specifically, the amount of retained austenite was found by measuring the diffraction X-ray integral intensities of the γ (220) plane and the α (211) plane. The results were then converted using the following equation.

$$\gamma(\text{volume fraction})=100/(1+(I_\alpha R_\gamma/I_\gamma R_\alpha))$$

In the equation, $I_\alpha$ represents the integral intensity of α, $R_\alpha$ represents a crystallographic theoretical calculation value for α, $I_\gamma$ represents the integral intensity of γ, and $R_\gamma$ represents a crystallographic theoretical calculation value for γ.

An arc-shaped tensile test specimen specified by API standard was taken from the quenched and tempered test material, and the tensile properties (yield stress, YS; tensile stress, TS) were determined in a tensile test conducted according to the API specification. The $Ac_3$ point (° C.) and $Ac_1$ point (° C.) in Table 2 were measured in a Formaster test using a test piece (4 mmϕ×10 mm) taken from the quenched test material. Specifically, the test piece was heated to 500° C. at 5° C./s, and to 920° C. at 0.25° C./s. After being held for 10 minutes, and test piece was cooled to room temperature at a rate of 2° C./s. The expansion and contraction of the test piece with this temperature history were then detected to obtain the $Ac_3$ point (° C.) and $Ac_1$ point (° C.).

The SSC test was conducted according to NACE TM0177, Method A. A test environment was created by adjusting the pH of a test solution (a 0.165 mass % NaCl aqueous solution; liquid temperature: 25° C.; $H_2S$: 1 bar; $CO_2$ bal.) to 3.5 with addition of 0.41 g/L of $CH_3COONa$ and HCl, and a stress 90% of the yield stress was applied under a hydrogen sulfide partial pressure of 0.1 MPa for 720 hours in the solution. Samples were determined as being acceptable when there was no crack in the test piece after the test, and unacceptable when the test piece had a crack after the test.

The results are presented in Table 2.

TABLE 1

| | Composition (mass %) | | | | | | | | | | |
|---|---|---|---|---|---|---|---|---|---|---|---|
| Steel No. | C | Si | Mn | P | S | Ni | Cr | Mo | Al | V | N |
| A | 0.0072 | 0.20 | 0.21 | 0.012 | 0.001 | 5.94 | 12.0 | 1.88 | 0.040 | 0.051 | 0.0035 |
| B | 0.0085 | 0.19 | 0.33 | 0.019 | 0.001 | 6.02 | 12.4 | 2.19 | 0.037 | 0.014 | 0.0054 |
| C | 0.0094 | 0.02 | 0.26 | 0.015 | 0.001 | 5.84 | 11.9 | 2.02 | 0.044 | 0.038 | 0.0078 |
| D | 0.0052 | 0.19 | 0.39 | 0.015 | 0.001 | 4.93 | 11.9 | 1.97 | 0.042 | 0.044 | 0.0048 |
| E | 0.0063 | 0.21 | 0.28 | 0.014 | 0.001 | 6.05 | 12.2 | 1.84 | 0.039 | 0.023 | 0.0054 |
| F | 0.0058 | 0.17 | 0.42 | 0.014 | 0.001 | 5.23 | 12.1 | 1.97 | 0.039 | 0.024 | 0.0101 |
| G | 0.0044 | 0.20 | 0.45 | 0.015 | 0.001 | 5.61 | 11.8 | 1.79 | 0.045 | 0.042 | 0.0089 |
| H | 0.0076 | 0.20 | 0.34 | 0.018 | 0.001 | 6.11 | 11.8 | 2.32 | 0.039 | 0.029 | 0.0094 |
| I | 0.0056 | 0.18 | 0.18 | 0.015 | 0.001 | 5.74 | 12.2 | 1.85 | 0.040 | 0.046 | 0.0075 |
| J | 0.0081 | 0.20 | 0.26 | 0.015 | 0.001 | 4.89 | 11.8 | 2.26 | 0.042 | 0.015 | 0.0086 |

TABLE 1-continued

| | | | | | | | | | | | |
|---|---|---|---|---|---|---|---|---|---|---|---|
| K | 0.0095 | 0.19 | 0.35 | 0.014 | 0.001 | 5.13 | 12.5 | 2.46 | 0.041 | 0.015 | 0.0044 |
| L | 0.0055 | 0.21 | 0.24 | 0.015 | 0.001 | 4.50 | 12.4 | 2.00 | 0.038 | 0.053 | 0.0113 |
| M | 0.0087 | 0.20 | 0.39 | 0.014 | 0.001 | 7.02 | 11.6 | 2.82 | 0.040 | 0.032 | 0.0079 |
| N | 0.0075 | 0.21 | 0.28 | 0.017 | 0.001 | 6.12 | 12.2 | 1.94 | 0.040 | 0.044 | 0.0067 |
| O | 0.0068 | 0.20 | 0.43 | 0.015 | 0.001 | 5.98 | 11.8 | 1.69 | 0.041 | 0.019 | 0.0084 |
| P | 0.0032 | 0.21 | 0.47 | 0.014 | 0.001 | 7.28 | 13.8 | 1.13 | 0.045 | 0.015 | 0.0549 |
| Q | 0.0091 | 0.18 | 0.07 | 0.015 | 0.001 | 4.82 | 10.4 | 2.62 | 0.039 | 0.036 | 0.0034 |
| R | 0.0028 | 0.19 | 0.49 | 0.015 | 0.001 | 7.29 | 14.5 | 2.69 | 0.040 | 0.015 | 0.0027 |
| S | 0.0092 | 0.20 | 0.07 | 0.013 | 0.001 | 4.68 | 10.5 | 1.08 | 0.041 | 0.042 | 0.0564 |

| | Composition (mass %) | | | | | | | |
|---|---|---|---|---|---|---|---|---|
| Steel No. | Ti | Cu | Co | Nb, W | Ca, REM, Mg, B | Value of formula (1) (*1) | Value of formula (2) (*2) | Remarks |
| A | 0.076 | 0.21 | 0.23 | — | — | 0.9 | −0.139 | Compliant Example |
| B | 0.092 | 0.07 | 0.09 | — | — | 0.4 | −0.137 | Compliant Example |
| C | 0.101 | 0.32 | 0.35 | — | — | −1.1 | −0.144 | Compliant Example |
| D | 0.106 | 0.14 | 0.17 | Nb: 0.04 | — | −10.9 | −0.154 | Compliant Example |
| E | 0.097 | 0.43 | 0.34 | W: 0.31 | — | 6.8 | −0.125 | Compliant Example |
| F | 0.072 | 0.03 | 0.08 | — | Ca: 0.003 | −5.8 | −0.142 | Compliant Example |
| G | 0.098 | 0.37 | 0.21 | — | Ca: 0.002, REM: 0.002 | 1.3 | −0.131 | Compliant Example |
| H | 0.113 | 0.24 | 0.25 | — | Mg: 0.003 | −2.2 | −0.146 | Compliant Example |
| I | 0.083 | 0.41 | 0.43 | — | B: 0.002 | 2.4 | −0.122 | Compliant Example |
| J | 0.095 | 0.06 | 0.14 | Nb: 0.02 | Ca: 0.002 | −17.0 | −0.165 | Compliant Example |
| K | 0.135 | 0.43 | 0.18 | — | — | −10.7 | −0.123 | Comparative Example |
| L | 0.078 | 0.05 | 0.09 | — | — | −13.5 | −0.148 | Comparative Example |
| M | 0.056 | 0.26 | 0.35 | — | — | 0.3 | −0.103 | Comparative Example |
| N | 0.094 | 1.09 | 0.24 | — | — | 10.1 | −0.060 | Comparative Example |
| O | 0.085 | 0.08 | 1.12 | — | — | 4.5 | −0.154 | Comparative Example |
| P | 0.021 | 0.87 | 0.15 | Nb: 0.08, W: 0.8 | — | 55.9 | −0.029 | Comparative Example |
| Q | 0.382 | 0.02 | 0.29 | — | — | −35.2 | −0.351 | Comparative Example |
| R | 0.012 | 0.94 | 0.42 | — | — | 28.5 | 0.072 | Comparative Example |
| S | 0.412 | 0.02 | 0.30 | W: 0.91 | — | −3.8 | −0.435 | Comparative Example |

* Underline means outside the range of the invention

* The remainder is Fe and incidental impurities (*1) Formula (1): −109.37C + 7.307Mn + 6.399Cr + 6.329Cu + 11.343Ni − 13.529Mo + 1.276W + 2.925Nb + 196.775N − 2.621Ti − 120.307

(*2) Formula (2): −1.324C + 0.0533Mn + 0.0268Cr + 0.0893Cu + 0.00526Ni + 0.0222Mo − 0.0132W − 0.473N − 0.5Ti − 0.514

TABLE 2

| | | Quenching | | | | | Tempering | |
|---|---|---|---|---|---|---|---|---|
| Steel pipe No. | Steel No. | $Ac_3$ point (° C.) | Heating temp. (° C.) | Holding time (min) | Cooling | Cooling stop temp. (° C.) | $Ac_1$ point (° C.) | Heating temp. (° C.) |
| 1 | A | 745 | 920 | 20 | Air cooling | 25 | 655 | 585 |
| 2 | B | 745 | 920 | 20 | Air cooling | 25 | 640 | 605 |

TABLE 2-continued

| | | | | | | | | |
|---|---|---|---|---|---|---|---|---|
| 3 | C | 735 | 920 | 20 | Air cooling | 25 | 660 | 595 |
| 4 | D | 715 | 920 | 20 | Water cooling | 25 | 635 | 590 |
| 5 | E | 755 | 920 | 20 | Water cooling | 25 | 650 | 585 |
| 6 | F | 715 | 920 | 20 | Air cooling | 25 | 660 | 610 |
| 7 | G | 735 | 920 | 20 | Air cooling | 25 | 660 | 605 |
| 8 | H | 720 | 920 | 20 | Air cooling | 25 | 655 | 595 |
| 9 | I | 750 | 920 | 20 | Air cooling | 25 | 660 | 605 |
| 10 | J | 670 | 920 | 20 | Air cooling | 25 | 625 | 575 |
| 11 | A | 745 | 730 | 20 | Air cooling | 25 | 655 | 585 |
| 12 | B | 745 | 920 | 20 | Air cooling | 25 | 640 | 645 |
| 13 | K | 690 | 920 | 20 | Air cooling | 25 | 665 | 615 |
| 14 | L | 685 | 920 | 20 | Air cooling | 25 | 660 | 610 |
| 15 | M | 730 | 920 | 20 | Air cooling | 25 | 665 | 600 |
| 16 | N | 745 | 920 | 20 | Water cooling | 25 | 645 | 605 |
| 17 | O | 800 | 920 | 20 | Water cooling | 25 | 665 | 610 |
| 18 | P | 795 | 920 | 20 | Air cooling | 25 | 675 | 615 |
| 19 | Q | 680 | 920 | 20 | Air cooling | 25 | 650 | 600 |
| 20 | R | 770 | 920 | 20 | Air cooling | 25 | 640 | 605 |
| 21 | S | 755 | 920 | 20 | Air cooling | 25 | 635 | 595 |

| | | | Microstructure | Tensile properties | | SSC resistance test | |
|---|---|---|---|---|---|---|---|
| Steel pipe No. | Steel No. | Holding time (min) | Retained γ (*1) (volume %) | Yield stress YS (MPa) | Tensile stress TS (MPa) | Presence or absence of cracking | Remarks |
| 1 | A | 60 | 0.17 | 839 | 871 | Absent | Present Example |
| 2 | B | 60 | 1.27 | 792 | 834 | Absent | Present Example |
| 3 | C | 60 | 0.51 | 841 | 878 | Absent | Present Example |
| 4 | D | 60 | 0.49 | 796 | 829 | Absent | Present Example |
| 5 | E | 60 | 0.21 | 822 | 856 | Absent | Present Example |
| 6 | F | 60 | 0.79 | 817 | 843 | Absent | Present Example |
| 7 | G | 60 | 0.56 | 824 | 864 | Absent | Present Example |
| 8 | H | 60 | 0.73 | 836 | 875 | Absent | Present Example |
| 9 | I | 60 | 0.42 | 827 | 869 | Absent | Present Example |
| 10 | J | 60 | 0.83 | 787 | 819 | Absent | Present Example |
| 11 | A | 60 | 4.32 | 761 | 813 | Present | Comparative Example |
| 12 | B | 60 | 5.68 | 764 | 826 | Present | Comparative Example |
| 13 | K | 60 | 0.62 | 826 | 874 | Present | Comparative Example |
| 14 | L | 60 | 0.94 | 794 | 835 | Present | Comparative Example |
| 15 | M | 60 | 0.78 | 822 | 876 | Present | Comparative Example |
| 16 | N | 60 | 0.37 | 840 | 884 | Present | Comparative Example |

TABLE 2-continued

| | | | | | | | |
|---|---|---|---|---|---|---|---|
| 17 | O | 60 | 0.43 | 836 | 879 | Present | Comparative Example |
| 18 | P | 60 | 2.79 | 840 | 891 | Present | Comparative Example |
| 19 | Q | 60 | 0.44 | 816 | 868 | Present | Comparative Example |
| 20 | R | 60 | 0.30 | 802 | 843 | Present | Comparative Example |
| 21 | S | 60 | 3.96 | 792 | 834 | Present | Comparative Example |

(*1) Retained γ: Retained austenite

* Underline means outside the range of the invention

The steel pipes of the present examples all had high strength with a yield stress of 758 MPa or more, demonstrating that the steel pipes were martensitic stainless steel seamless pipes having excellent SSC resistance that do not crack even when placed under a stress in a $H_2S$-containing environment. On the other hand, in Comparative Examples outside the range of the present invention, the steel pipes did not have excellent SSC resistance, even though the desired high strength was obtained.

The invention claimed is:

1. A martensitic stainless steel seamless pipe for oil country tubular goods, the martensitic stainless steel seamless pipe having a composition that comprises, in mass %, C: 0.0010 to 0.0094%, Si: 0.5% or less, Mn: 0.05 to 0.5%, P: 0.030% or less, S: 0.005% or less, Ni: 4.6 to 7.3%, Cr: 10.0 to 14.5%, Mo: 1.0 to 2.7%, Al: 0.1% or less, V: 0.2% or less, N: 0.1% or less, Ti: 0.01 to 0.50%, Cu: 0.01 to 1.0%, and Co: 0.01 to 1.0%, in which the values of the following formulae (1) and (2) satisfy the formulae (3) below, and the balance is Fe and incidental impurities:

$$-109.37C+7.307Mn+6.399Cr+6.329Cu+11.343Ni-13.529Mo+1.276W+2.925Nb+196.775N-2.621Ti-120.307, \quad \text{Formula (1)}$$

$$-1.324C+0,0533Mn+0.0268Cr+0.0893Cu+0.00526Ni+0.0222Mo-0.0132W-0.473N-0.5Ti-0.514, \quad \text{Formula (2)}$$

wherein C, Mn, Cr, Cu, Ni, Mo, W, Nb, N, and Ti represent the content of each element in mass %, and the content is 0 (zero) for elements that are not contained, $$-35.0 \leq \text{value of formula (1)} \leq 45, \text{ and}$$

$$-0.40 \leq \text{value of formula (2)} \leq 0.070, \quad \text{Formulae (3)}$$

wherein the martensitic stainless steel has a yield stress of 758 MPa or more, and wherein the martensitic stainless steel seamless pipe does not crack when subjected to a sulfide stress corrosion test according to NACE TM0177 Method A, using a 0.165 mass NaCI aqueous solution with a liquid temperature of 25° C., $H_2S$: 1 bar and $CO_2$ bal., the NaCI solution adjusted to a pH of 3.5 with addition of 0.41 g/L of $CH_3COONa$ and HCI, and applying a stress of 90 of the yield stress under a hydrogen sulfide partial pressure of 0.1 MPa for 720 hours in the NaCI solution.

2. The martensitic stainless steel seamless pipe for oil country tubular goods according to claim 1, wherein the composition further comprises, in mass %, one or two selected from Nb: 0.25% or less, and W: 1.1% or less.

3. The martensitic stainless steel seamless pipe for oil country tubular goods according to claim 1, wherein the composition further comprises, in mass %, one, two or more selected from Ca: 0.010% or less, REM: 0.010% or less, Mg: 0.010% or less, and B: 0.010% or less.

4. The martensitic stainless steel seamless pipe for oil country tubular goods according to claim 2, wherein the composition further comprises, in mass %, one, two or more selected from Ca: 0.010% or less, REM: 0.010% or less, Mg: 0.010% or less, and B: 0.010% or less.

5. A method for manufacturing a martensitic stainless steel seamless pipe for oil country tubular goods according to claim 1, the method comprising:

forming a steel pipe from a steel pipe material of the composition of claim 1;

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

6. A method for manufacturing a martensitic stainless steel seamless pipe for oil country tubular goods according to claim 2, the method comprising:

forming a steel pipe from a steel pipe material of the composition of claim 2;

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

7. A method for manufacturing a martensitic stainless steel seamless pipe for oil country tubular goods according to claim 3, the method comprising:

forming a steel pipe from a steel pipe material of the composition of claim 3;

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

8. A method for manufacturing a martensitic stainless steel seamless pipe for oil country tubular goods according to claim 5, the method comprising:

forming a steel pipe from a steel pipe material of the composition of claim 5;

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

* * * * *